US010384908B2

(12) United States Patent
Maleck et al.

(10) Patent No.: US 10,384,908 B2
(45) Date of Patent: Aug. 20, 2019

(54) METHOD FOR A TEXTILE MACHINE, AND A TEXTILE MACHINE

(71) Applicant: Rieter Ingolstadt GmbH, Ingolstadt (DE)

(72) Inventors: Mario Maleck, Walting (DE); Thomas Gruber, Ingolstadt (DE); Robin Wein, Ingolstadt (DE); Christian Kettner, Koesching (DE); Robert Hagl, Rottenegg (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 315 days.

(21) Appl. No.: 15/224,605

(22) Filed: Jul. 31, 2016

(65) Prior Publication Data

US 2017/0029234 A1 Feb. 2, 2017

(30) Foreign Application Priority Data

Jul. 31, 2015 (DE) ..... 10 2015 112 661

(51) Int. Cl.
*B65H 67/08* (2006.01)
*D01H 13/04* (2006.01)
(Continued)

(52) U.S. Cl.
CPC ..... *B65H 67/085* (2013.01); *B65H 54/28* (2013.01); *B65H 57/003* (2013.01); *D01H 1/115* (2013.01);
(Continued)

(58) Field of Classification Search
CPC ..... B65H 67/085; D01H 13/045
See application file for complete search history.

(56) References Cited

U.S. PATENT DOCUMENTS 3,131,879 A 5/1964 Glastra et al.
3,754,718 A * 8/1973 Abbott ..... B65H 67/085 242/476
(Continued)

FOREIGN PATENT DOCUMENTS

CN 1840458 A 10/2006
CN 104030090 A 9/2014
(Continued)

OTHER PUBLICATIONS

Machine Translation EP 2957532, retrieved Sep. 12, 2018.*
(Continued)

*Primary Examiner* — Shaun R Hurley
(74) *Attorney, Agent, or Firm* — Dority & Manning, P.A.

(57) ABSTRACT

A textile machine and associated operational method are provided, wherein the textile machine has a plurality of workstations for (a) delivering a thread to a bobbin, (b) laying the thread on the bobbin, (c) winding the thread on the bobbin, and (d) finding a thread end wound on the bobbin with a suction nozzle. The thread is run through the suction nozzle during delivery to the bobbin such that the thread enters an inlet mouth in the suction nozzle and exits the suction nozzle through an extraction mouth. Starting from a thread delivery device at the workstation, the thread is run freely until the thread enters the inlet mouth of the suction nozzle directly in front of the bobbin. For finding of the thread end wound on the bobbin, the thread end is sucked into the suction nozzle through the extraction mouth.

16 Claims, 8 Drawing Sheets

(51) Int. Cl.

| | |
|---|---|
| ***D01H 1/115*** | (2006.01) |
| ***D01H 4/30*** | (2006.01) |
| ***B65H 54/28*** | (2006.01) |
| ***B65H 57/00*** | (2006.01) |

(52) U.S. Cl.
CPC ..... *D01H 4/30* (2013.01); *D01H 13/045* (2013.01); *B65H 2701/31* (2013.01)

(56) References Cited

U.S. PATENT DOCUMENTS 3,866,848 A * 2/1975 Abbott ..... B65H 67/085 242/476
5,056,728 A * 10/1991 Scaglia ..... B65H 67/08 226/97.4
5,195,314 A * 3/1993 Stahlecker ..... D01H 5/005 57/279
5,772,137 A * 6/1998 Gilbos ..... B65H 54/026 242/478.2
5,862,660 A * 1/1999 Haasen ..... B65H 63/06 242/475.1
6,804,945 B2 10/2004 Straaten
2002/0023982 A1* 2/2002 Kargel ..... B65H 54/88 242/475.5
2003/0038206 A1 2/2003 Grecksch et al.
2017/0081142 A1* 3/2017 Maleck ..... B65H 51/10

FOREIGN PATENT DOCUMENTS

| | | | |
|---|---|---|---|
| DE | 101 39 074 | A1 | 2/2003 |
| EP | 0 128 121 | A1 | 12/1984 |
| EP | 1 283 288 | A2 | 2/2003 |
| EP | 2 444 347 | A2 | 4/2012 |
| EP | 2 957 532 | A1 | 12/2015 |

OTHER PUBLICATIONS

German Search Report, dated Jun. 9, 2016.
EP Search Report, dated Dec. 5, 2016.
Chinese Office Action, dated Jan. 14, 2019.

* cited by examiner

METHOD FOR A TEXTILE MACHINE, AND A TEXTILE MACHINE

FIELD OF THE INVENTION

The invention relates to a method on a textile machine, in particular a spinning or a winding machine with multiple similar workstations, for delivering a thread to a bobbin, for laying the thread on the bobbin, for winding the thread on the bobbin, and for finding a thread end wound on the bobbin by means of a suction nozzle, whereas the thread end is sucked in by means of an opening turned towards the bobbin circumference that serves as an extraction mouth of the suction nozzle. The invention also relates to a corresponding textile machine with a thread delivery device, a thread traversing device, a winding device and a suction nozzle with an extraction mouth.

BACKGROUND

A spinning device of an open-end rotor spinning machine is known from EP 1 283 288 A2. A thread is spun in an open-end spinning device and delivered to a winding device. For the defined laying of the delivered thread on a bobbin, a thread traversing device driven by a single motor is provided. After a thread break, the thread end that arises from this is wound onto the bobbin. In order to use such thread end for re-attachment with a new thread, it must be sought out on the bobbin. For this purpose, a swivel-mounted suction nozzle that is subject to negative pressure is provided. In the event of a thread breakage, the suction nozzle swivels from a lower position upwards to the bobbin circumference of the bobbin and subjects it to suction. The bobbin is set in a rotational movement, such that, after a certain time, the thread end is captured and extracted with suction by the suction nozzle. Subsequently, additional handling takes place in order to use the thread end for re-attachment. For this purpose, the thread end is delivered by the suction nozzle to other devices. This procedure is time-consuming, since the suction nozzle must be first set in motion and the thread end that is found must be delivered to other handling devices through corresponding movements. In addition, the structural complexity and the installation space required are considerable.

A suction nozzle arranged in a fixed location, which is allocated to a bobbin on a winding machine, is known from EP 0 128 121 A1. Upon a thread breakage or prior to the attachment of the thread of a new delivery bobbin on the thread end of the thread wound on the bobbin, the bobbin is stopped. Subsequently, it is rotated in the direction counter to the winding direction, in order to wind a thread end of the bobbin that is sufficiently long for the attachment process. So that the end that is generally strongly adhering on the bobbin surface can be found and detached, a suction source is turned on and negative pressure is built up in the suction nozzle, which propagates through the mouth up to the bobbin surface. Given the negative pressure, air from the environment is sucked in through the gap between the mouth lips of the nozzle. At that point, the thread end drawn in from the bobbin surface by the negative pressure that is prevailing there is captured, carried away and drawn off by the powerful current in the interior of the nozzle. The disadvantage here is also that the thread end that is found must be removed from the nozzle, prepared for attachment and brought back into the normal thread path. Moreover, during operation, this device is time-consuming and accordingly disadvantageous for the efficiency of the machine.

A winding machine that guides the thread in a thread guide channel between the feed bobbin and the winding device positioned in the unwinding position and completely encloses it is known from EP 2 444 347 A2. After the guiding channel, a suction head that can be swiveled is provided, with which a thread end can be captured on the bobbin and can be clamped between the bobbin and the mouth of the suction head. For the further handling of the thread, it must be delivered back to other handling devices. In the thread guide channel, various thread monitoring devices and thread treatment devices are arranged. Because of the long, stationary thread guiding channel, in the event of clogging caused by the thread, cleaning can be very complex.

SUMMARY OF THE INVENTION

Thus, a task of the present invention is to provide a method and a device with which a thread end can be both quickly found and attached to a new thread without great effort, so that the production of the thread can be continued with only a brief break. Additional objects and advantages of the invention will be set forth in part in the following description, or may be obvious from the description, or may be learned through practice of the invention.

The task is solved with the characteristics of the method and system described herein.

The method in accordance with the invention on a textile machine, in particular a spinning or a winding machine with multiple similar workstations, serves the purpose of delivering a thread to a bobbin, for laying the thread on the bobbin, for winding the thread onto the bobbin, and for finding a thread end wound on the bobbin by means of a suction nozzle. The thread end is sucked in by means of an opening turned towards the bobbin circumference that serves as an extraction mouth of the suction nozzle. In order to rapidly find the thread end on the bobbin upon a break of the thread, and to rapidly make it available for a re-attachment on a new thread, it is provided that, during the delivery to the bobbin (that is, during the normal production of the thread), the thread runs through the suction nozzle. The thread enters through an additional opening in the suction nozzle serving as an inlet mouth for the thread and exits the suction nozzle through another opening, in particular through the extraction mouth. The thread runs from a thread delivery device, which may be a spinning unit or a cop of a winding machine, initially freely, and only enters the suction nozzle directly in front of the bobbin. Given the fact that, during the normal delivery process, the thread is located directly in front of the bobbin in the suction nozzle, upon attachment after a thread break and the finding of the thread end, it need not be removed from the suction nozzle, brought into another thread path and newly attached; rather, after finding the thread end it may remain in the suction nozzle and in the thread path. This saves time upon the re-attachment of the thread on a new thread. In doing so, the productivity of the machine and its efficiency can be increased. Given the fact that, starting from the thread delivery device, the thread runs initially freely (that is, not through the suction nozzle) and only enters the suction nozzle directly in front of the bobbin, the handling of the thread is very easy. For example, draw-off devices for drawing off the thread from the delivery point can thereby be easily operated. Moreover, the threading of the thread into the suction nozzle may take place without any problems, since long paths of the thread need not be covered in the closed suction nozzle. Thus, the clogging of the suction nozzle is reliably avoided. Thereby, the suction nozzle is relatively short. A thread path with a length of less than 80 cm, preferably of less than 40 cm, inside the suction nozzle has proved to be particularly advantageous.

Moreover, the structure of the textile machine working according to this method is much simpler than that of the state of the art, since handling devices that must remove the thread end from the suction nozzle and must bring the thread end into the normal thread path are not necessary, or at least are not necessary to a considerable extent.

More preferably, during normal delivery, the thread proceeds to the bobbin through both the inlet mouth and through the extraction mouth of the suction nozzle. Thereby, after being sucked in, the thread may be guided counter to the delivery direction into the extraction mouth and the inlet mouth and, after the attachment of the thread, moved back into the normal delivery direction, without significantly changing the position.

In a particularly advantageous version of the invention, the suction nozzle is connected to an extraction system either through the inlet mouth or a third opening serving as a connection mouth. The extraction system generates negative pressure in the suction nozzle and thereby causes the negative pressure then applied in the extraction opening to find the thread end on the bobbin circumference, if the bobbin moves in particular against the normal winding direction along the extraction opening. The connection of the suction nozzle to the extraction system through the existing inlet mouth is provided particularly well. In an additional version of the invention, it may also be advantageous that a third opening is arranged on the suction nozzle, which is connected to the extraction system. At this point, the extraction system may be permanently connected, and a movement of the components guiding the negative pressure need not be carried out.

If the inlet mouth is closed for sealing the suction nozzle upon the sucking in of the thread end, in a particularly advantageous manner, the negative pressure at the extraction mouth is increased. Thus, suction losses through the inlet mouth are avoided.

If, upon the sucking in of the thread end, the inlet mouth is connected to the extraction system through a connection element, with this version of the invention as well, the significant component guiding the negative pressure is firmly arranged in the machine. Only the connection element must be moved. This may take place rapidly and without great construction effort.

If the extraction mouth of the suction nozzle is moved into at least two, preferably three, positions at different distances from the bobbin circumference, various states may be optimally addressed. This may be used, in particular, for special requirements upon the normal delivery operation of the thread, when searching for the thread or, when needed, for the special handling of the thread, for example for lifting the thread from a traverse thread guide. Through the various positions of the extraction mouth in relation to the bobbin circumference, a highly rapid finding of the thread end and handling of the thread end may be carried out for re-attachment.

It is particularly advantageous if the movement of the adjustable extraction mouth is coupled with a thread lifter and/or with a thread guide of the thread traversing device. This coupling may take place mechanically or by means of an electronic control. The coupling may be such that, at a certain position of the extraction mouth, the thread lifter lifts the thread from the thread guide, such that it no longer oscillates at the surface of the bobbin and/or that the thread guide of the thread traversing device brings about the fact that it moves out of the area of the bobbin or the extraction mouth, in order to be out of the way for the movement of the extraction mouth.

It is particularly advantageous if the extraction mouth is arranged in the first, in particular the middle, position of the extraction mouth, if, during the normal delivery to the bobbin, it is wound on it. In this first position, the extraction mouth is positioned such that it is not in the way of the thread path. It is neither too close to the bobbin, where it could obstruct the winding of the thread on the bobbin, nor is it retracted too far to hinder the thread path in the suction nozzle.

In the second, in particular closer position, of the extraction mouth, the thread end is sought on the bobbin through the extraction mouth. Thus, the extraction mouth is located close to the bobbin circumference, and may exert a particularly high suction force on the surface of the bobbin.

If the second position of the extraction mouth is adjusted as a function of the bobbin diameter and/or the thread to be received, the thread end may be found and received very quickly and safely.

In the third, in particular distant, location of the extraction mouth, a thread lifter is actuated. The thread lifter causes the thread to be lifted out or kept out from the thread traversing device. The thread guide may be moved into this position out from the area of the extraction mouth, in order to not hinder the handling of the thread. This position is particularly advantageous if the thread is located in the suction nozzle, but is not to oscillate.

A textile machine in accordance with the invention, in particular a spinning or a winding machine with multiple similar workstations, features in each case (that is, for each workstation) a thread delivery device for delivering a thread to a bobbin, a thread traversing device for laying the thread on the bobbin, a winding device for winding the thread onto the bobbin, and a suction nozzle for finding a thread end wound on the bobbin. The suction nozzle also features an opening serving as an extraction mouth for sucking in the thread end turned towards the bobbin circumference. The suction nozzle may be designed to be stationary or movable. Preferably, however, it is attached to the workstation in a stationary manner. In accordance with the invention, the suction nozzle features, in addition to the extraction mouth, an additional opening serving as an inlet mouth for the thread, whereas the thread runs through the suction nozzle during the delivery to the bobbin. Thereby, the thread enters the suction nozzle through the inlet mouth, and exits the suction nozzle through another opening, in particular the extraction mouth. Thus, the suction nozzle features at least two different mouths through which the thread passes during the delivery to the bobbin. Thus, the difference in the thread path during normal delivery compared to the position of the thread when finding the thread end and upon its suction into the suction nozzle is not different or only slightly different. Thus, the handling of the thread end for its use upon re-attaching the thread to a new thread is particularly easy to carry out. The handling of the thread may thereby take place very quickly and easily. Moreover, the structural complexity may be kept low. For the handling of the thread, it is particularly advantageous if the suction nozzle is only arranged directly in front of the bobbin, such that the thread, starting from the thread delivery device, initially runs free, and only enters the suction nozzle directly in front of the bobbin. A thread path with a length of less than 80 cm, preferably of less than 40 cm, inside the suction nozzle has been found to be particularly advantageous for avoiding the clogging of the suction nozzle and leaving sufficient space in order to, for example, operate the thread draw-off device or a thread joining device, manually or with corresponding handling devices.

It is particularly advantageous if the suction nozzle is stationary at the workstation. In doing so, the movement of the suction nozzle itself is not necessary. Thereby, the structure of the suction nozzle and the attachment to the workstation may be particularly simple.

Advantageously, the suction nozzle is designed in such a manner that a connection through the inlet mouth or a third opening serving as a connection mouth to an extraction system can be effected. When connecting the extraction system to the inlet mouth, the structural complexity can be kept very low. However, with such a version, there is a risk that the installation space that is available at such point is low, such that the arrangement of the connection of the suction nozzle to the extraction system at such point may be problematic. The arrangement of the extraction system through a third opening serving as a connection mouth at the suction nozzle is more simple. This opening may be arranged in an area of the suction nozzle at which more installation space is available. Thereby, the version of this variant of the intention may be easy to carry out.

In a preferred version of the invention, a closing element is allocated to the inlet mouth. The closing element serves the purpose of sealing the suction nozzle in upon sucking in the thread end. This version, which will be provided in particular in conjunction with a third opening serving as a connection mouth to an extraction system is used so that the negative pressure at the extraction mouth is high and is not weakened by additional openings that are not needed at the present moment. As a rule, the finding of the thread end with a high negative pressure at the extraction mouth is more rapid and more reliable than it is with a low negative pressure.

If a connection element is allocated to the inlet mouth for connecting the suction nozzle with the extraction system upon the sucking in of the thread end, both the suction nozzle and the extraction system and the corresponding suction pipe connections may be arranged at the workstation in a stationary manner. Through the connection element, the suction nozzle may be connected to the negative pressure of the extraction system.

Preferably, the connection element and/or the closing element for the inlet mouth may be mounted in a swiveling or displaceable manner. In this manner, the connection of the suction nozzle to the extraction system or the closing of the inlet mouth, which is not needed at the present moment, may be carried out very easily.

If the extraction mouth of the suction nozzle is adjustable, in particular if it is displaceable, the extraction mouth may be placed in various positions with respect to the bobbin circumference of the bobbin. In this manner, negative pressure may be generated in a targeted manner on the surface of the bobbin, or the extraction mouth may be moved from an area that is disruptive for the thread end.

If the adjustable extraction mouth is coupled with a thread lifter and/or with a thread guide of the thread traversing device, because of the movement of the extraction mouth, a movement of the thread lifter or the thread guide may be effected. In particular, the coupling of the extraction mouth and the thread lifter may be effected by means of a slotted link guide. Through the movement of the extraction mouth, the thread lifter is guided along this slotted link, and corresponding movements can be carried out, in particular the lifting or lowering of the thread from the thread guide.

Upon a corresponding position of the extraction mouth, the thread guide of the thread traversing device may be moved out of the area of the extraction mouth. This preferably occurs by means of an electronic circuit, which, in a particular state of the machine, causes the thread guide to move out of the critical area. This is particularly advantageous if the thread traversing device and/or the winding device feature individual drives. Through these individual drives, the individual workstation, regardless of the other workstations, can carry out a specific movement of the thread traversing device or the winding device, as the case may be, that is needed at the present moment.

BRIEF DESCRIPTION OF THE DRAWINGS

Further advantages of the invention are described in the following embodiments. The following is shown.

DETAILED DESCRIPTION

Figure 1:
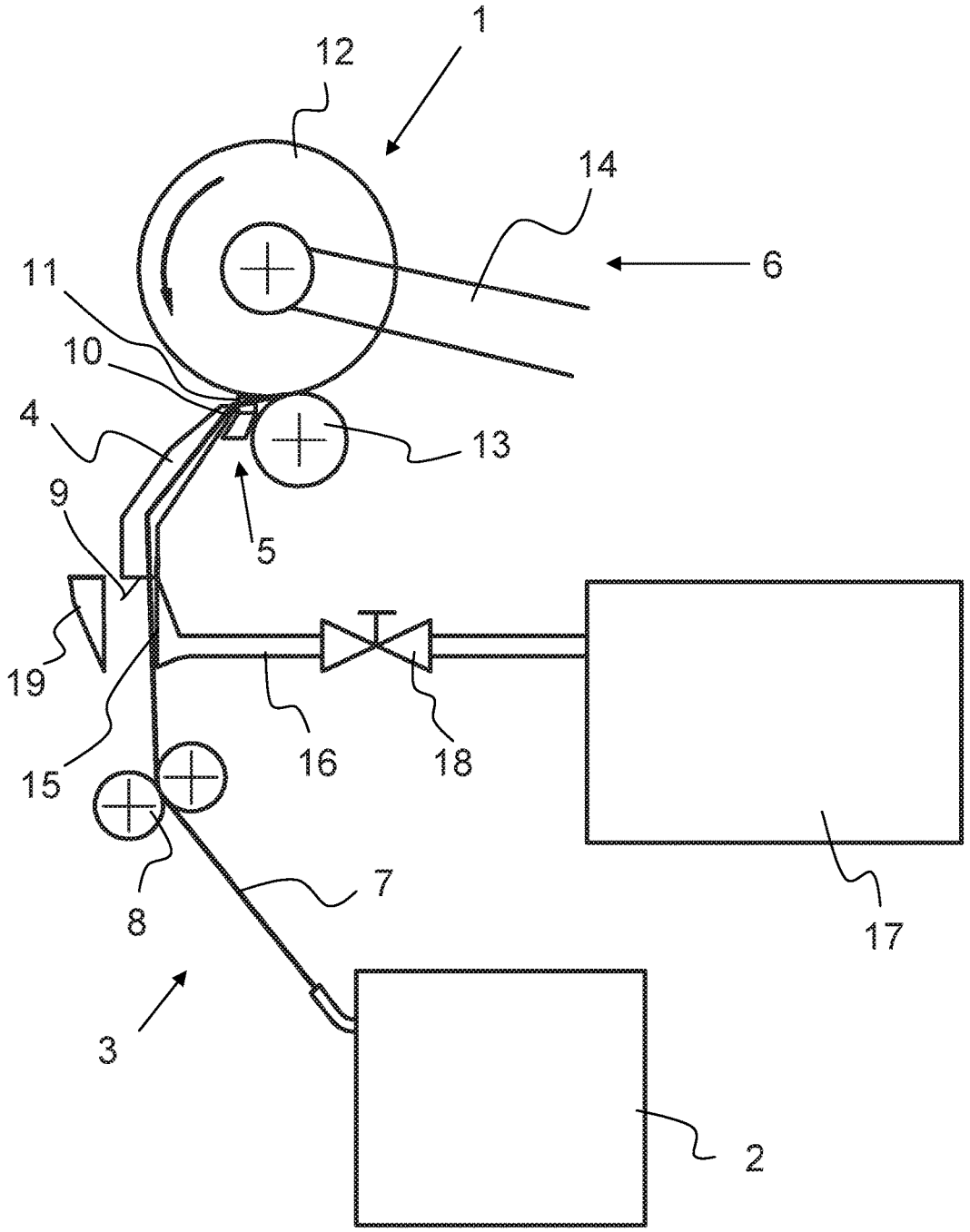
FIG. 1 is a schematic presentation of a workstation upon the delivery of a thread.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 presents a workstation 1 with a spinning unit 2, a thread delivery device 3, a suction nozzle 4, a thread traversing device 5 and a winding device 6. In the spinning unit 2, a thread 7 is produced and withdrawn by means of delivery rollers 8 from the spinning unit 2. The thread 7 then arrives, after it runs freely up to this point, directly in front of a bobbin 12 of the winding device 6 through an inlet mouth 9 into the suction nozzle 4, and exits again from it through the extraction mouth 10. From the thread traversing device 5 arranged between the extraction mouth 10 of the suction nozzle 4 and the winding device 6, the thread 7 is wound onto the bobbin 12 by means of a thread guide 11 that moves back and forth. The bobbin 12 rotates in the direction of the arrow, in order to wind the thread 7. The bobbin 12 is held in a bobbin arm 14 and is driven with a rotating winding roller 13. Given that the thread 7 runs freely over a long distance, it can be inserted between the delivery rollers 8 without any problem when attaching the thread 7, or fed into the spinning unit 2.

A connection mouth 15 of a suction line 16 is arranged in the area of the inlet mouth 9. The suction line 16 is connected to an extraction system 17, in which negative pressure prevails. The suction line 16 can be shut off by means of a valve 18, such that, only when necessary, negative pressure applies at the connection mouth 15 of the suction line 16.

The suction nozzle 4 with the inlet mouth 9 and the suction line 16 with the connection mouth 15 are designed separately from each other. While the thread 7 is delivered to the bobbin 12, the thread 7 runs past the connection mouth 15 and in the inlet mouth 9 into the suction nozzle 4. A connection element 19, which is capable of connecting the inlet mouth 9 to the connection mouth 15, is arranged laterally offset to the thread path, such that the thread 7 is not hindered.

Figure 2:
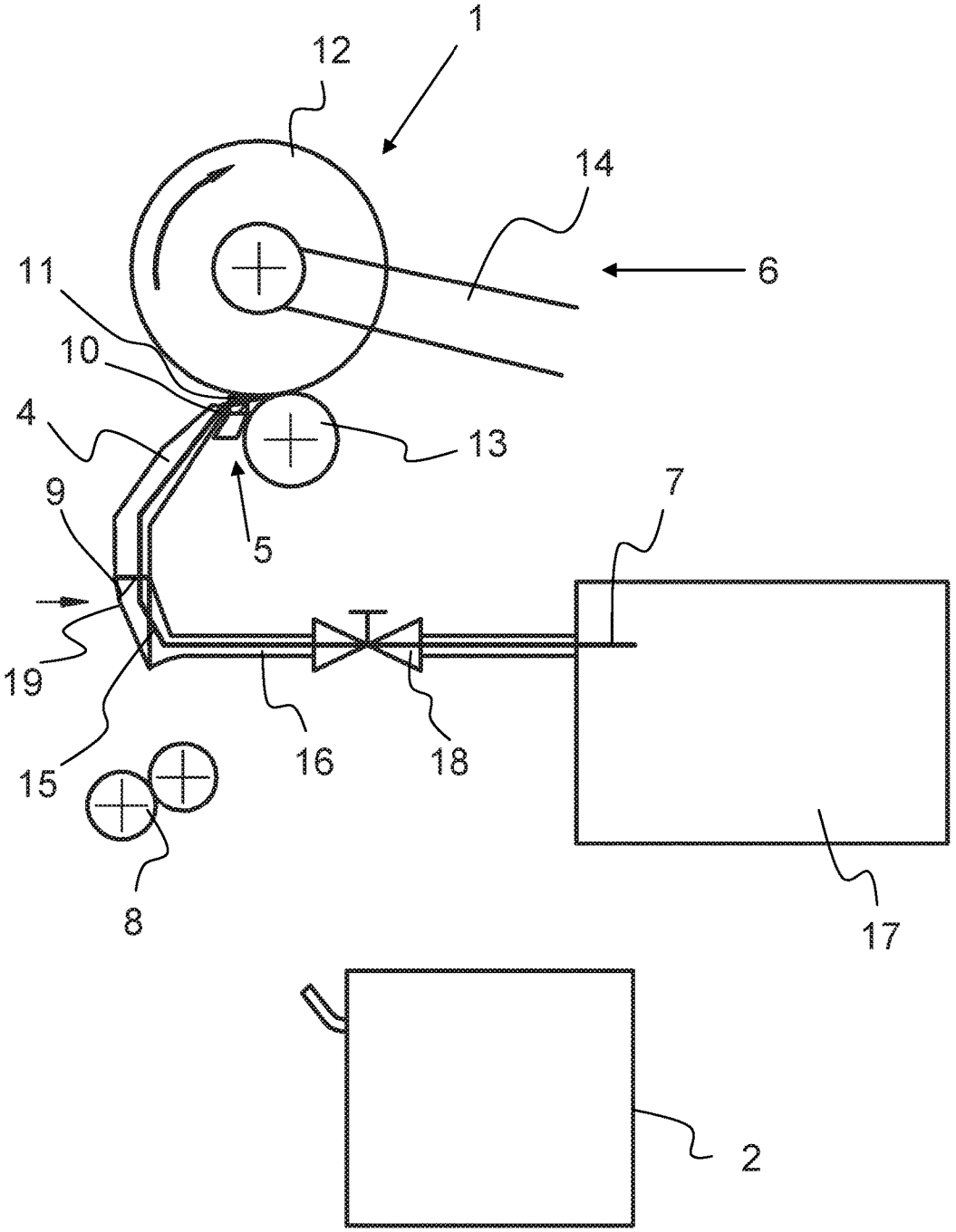
FIG. 2 is the workstation from FIG. 1 upon the return delivery of the thread.

FIG. 2 shows the workstation of FIG. 1. In contrast to the presentation of FIG. 1, with FIG. 2, the thread 7 is delivered back by the bobbin 12. The thread 7 was previously broken, such that the thread end has been wound on the bobbin 12. In order to find and receive the thread 7 or its thread end, as the case may be, on the surface of the bobbin 12, the extraction mouth 10 of the suction nozzle 4 is subjected to suction. The suction takes place in such a manner that the connection element 19 connects the inlet mouth 9 to the connection mouth 15. Thus, with an opening of the valve 18, negative pressure from the extraction system 17 prevails in the suction nozzle 4 through the suction line 16. Thus, the connection element 19 creates a continuous suction channel, which consists of the suction nozzle 4, the connection element 19 and the suction line 16. After the thread 7 is found on the circumference of the bobbin 12, the thread 7 is sucked into this suction channel, and may then be further treated. A treatment may consist in the fact, for example, that the thread 7 is cut to length, and the thread end that thereby arises is prepared for a piecing in the spinning unit 2.

Through the removal of the connection element 19 and thus the new opening of the suction nozzle 4, the thread end stretched by the negative pressure can be captured by the operator or a handling device and removed from the channel for further treatment.

Figure 3:
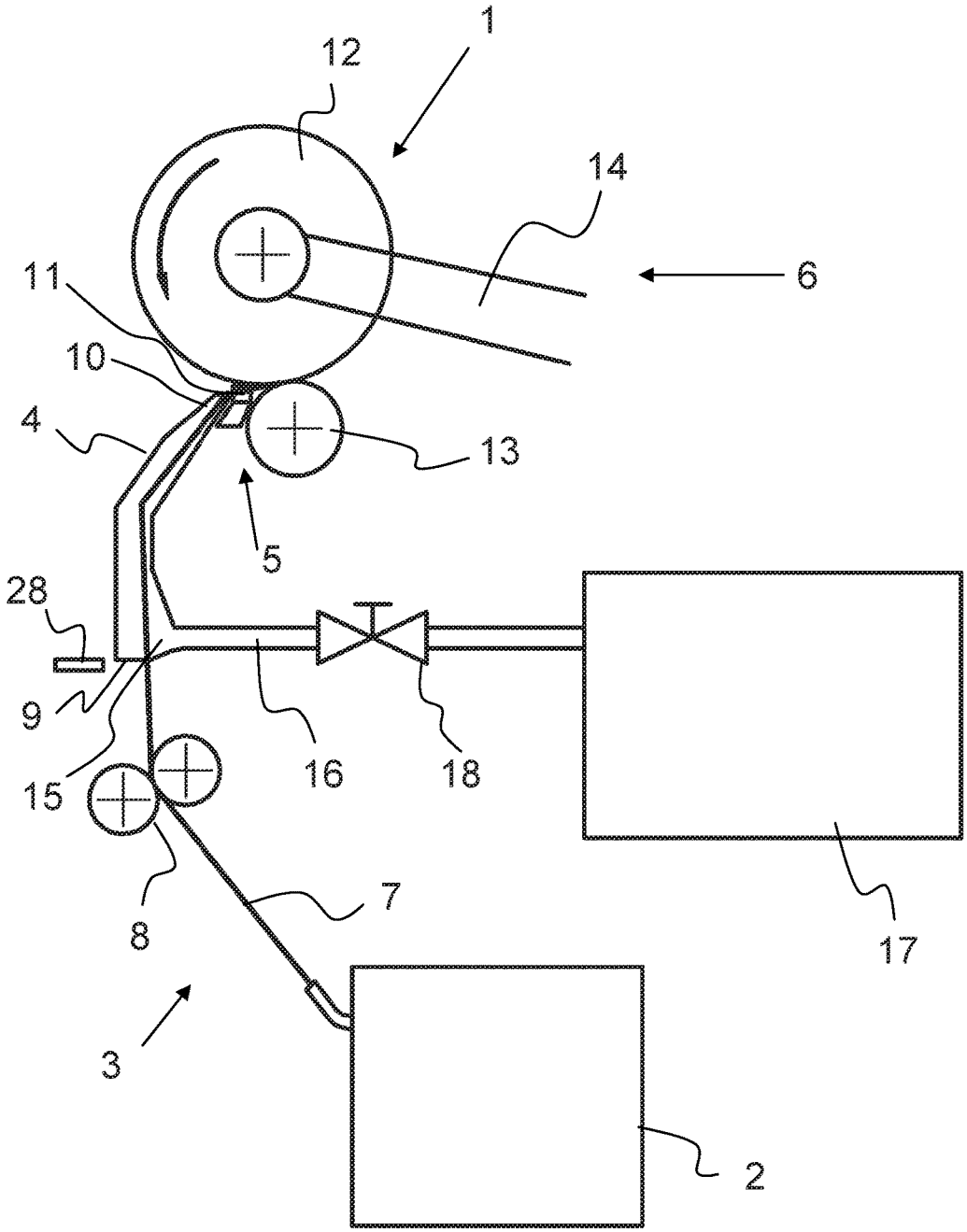
FIG. 3 is a schematic presentation of a workstation with a suction nozzle with three mouths upon the delivery of a thread.

FIG. 3 shows an additional workstation 1, which is similar to the workstation 1 of FIG. 1. In contrast to the version of FIG. 1, however, this features a suction nozzle 4, which has three openings. In addition to the inlet mouth 9 and the extraction mouth 10, the connection mouth 15 is integrated in the suction nozzle 4. As with FIG. 1, a connection of the inlet mouth 9 and the connection mouth 15 is accordingly not necessary. In the normal thread path—upon the delivery of the thread 7—the thread 7, as also previously described above, enters the suction nozzle 4 through the inlet mouth 9, and leaves it once again through the extraction mouth 10, before it is wound on the bobbin 12 rotating in the direction of the arrow. A closing element 28 is allocated to the inlet mouth 9. Upon the delivery of the thread 7, the closing element 28 is located outside of the thread path, in order to not disrupt it. The suction line 16 may be shut off.

Figure 4:
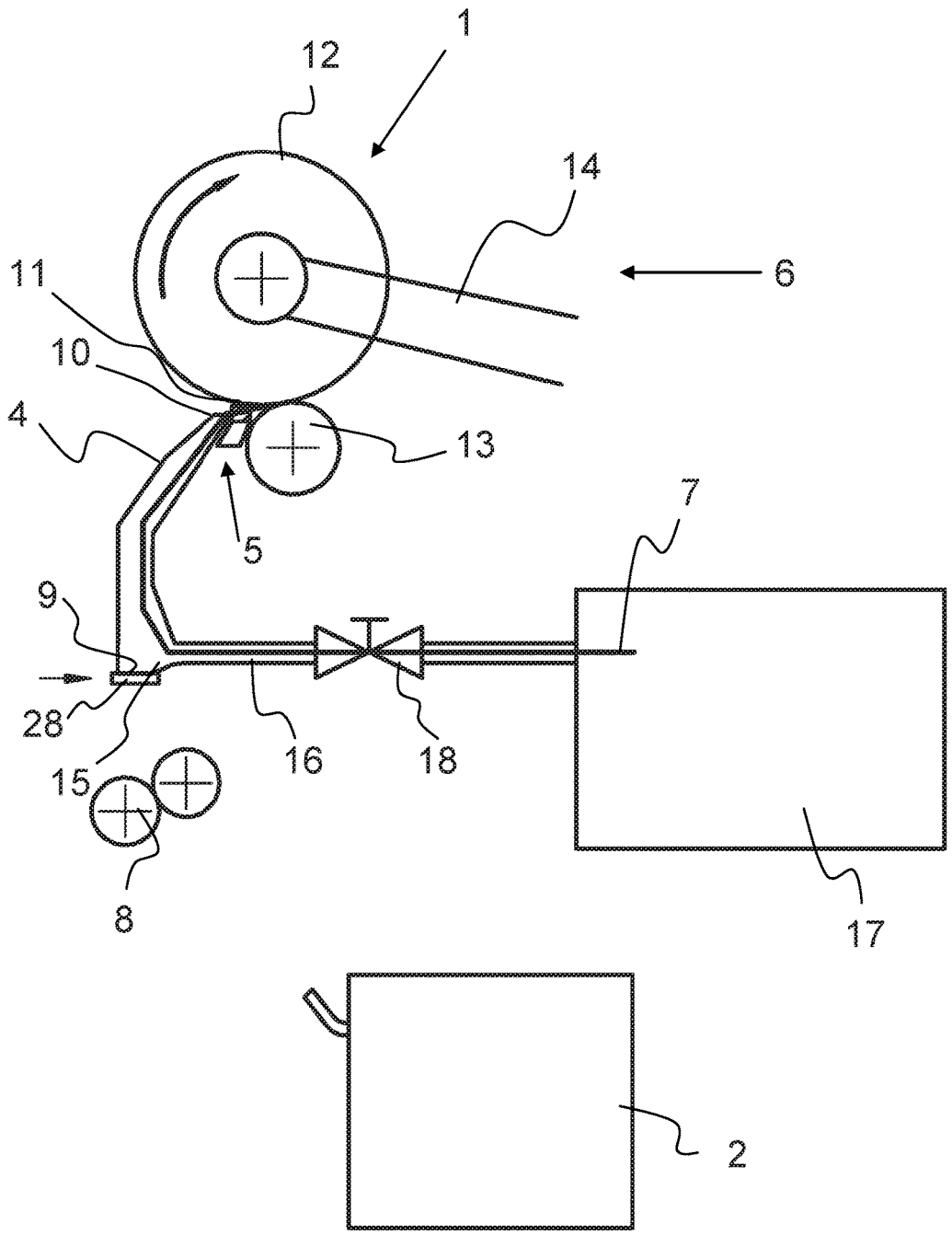
FIG. 4 is the workstation from FIG. 3 upon the return delivery of the thread.

In FIG. 4, in a manner analogous to FIG. 2, with a workstation 1 in accordance with FIG. 3, the return delivery of the thread 7 or the thread end, as the case may be, is shown. The bobbin 12 rotates in the direction of the arrow counter to the winding direction. The thread end has been previously captured by the extraction mouth 10 of the suction nozzle 4 and extracted by suction by the negative pressure of the extraction system 17 with an open valve 18. In order to generate the highest possible negative pressure at the extraction mouth 10, the inlet mouth 9 is blocked by the closing element 28. The thread 7 is thus located in an essentially closed suction channel, which is formed from the suction nozzle 4, the closing element 28 and the suction line 16. In this case the connection mouth 15 is part of the suction nozzle 4.

Figure 5:
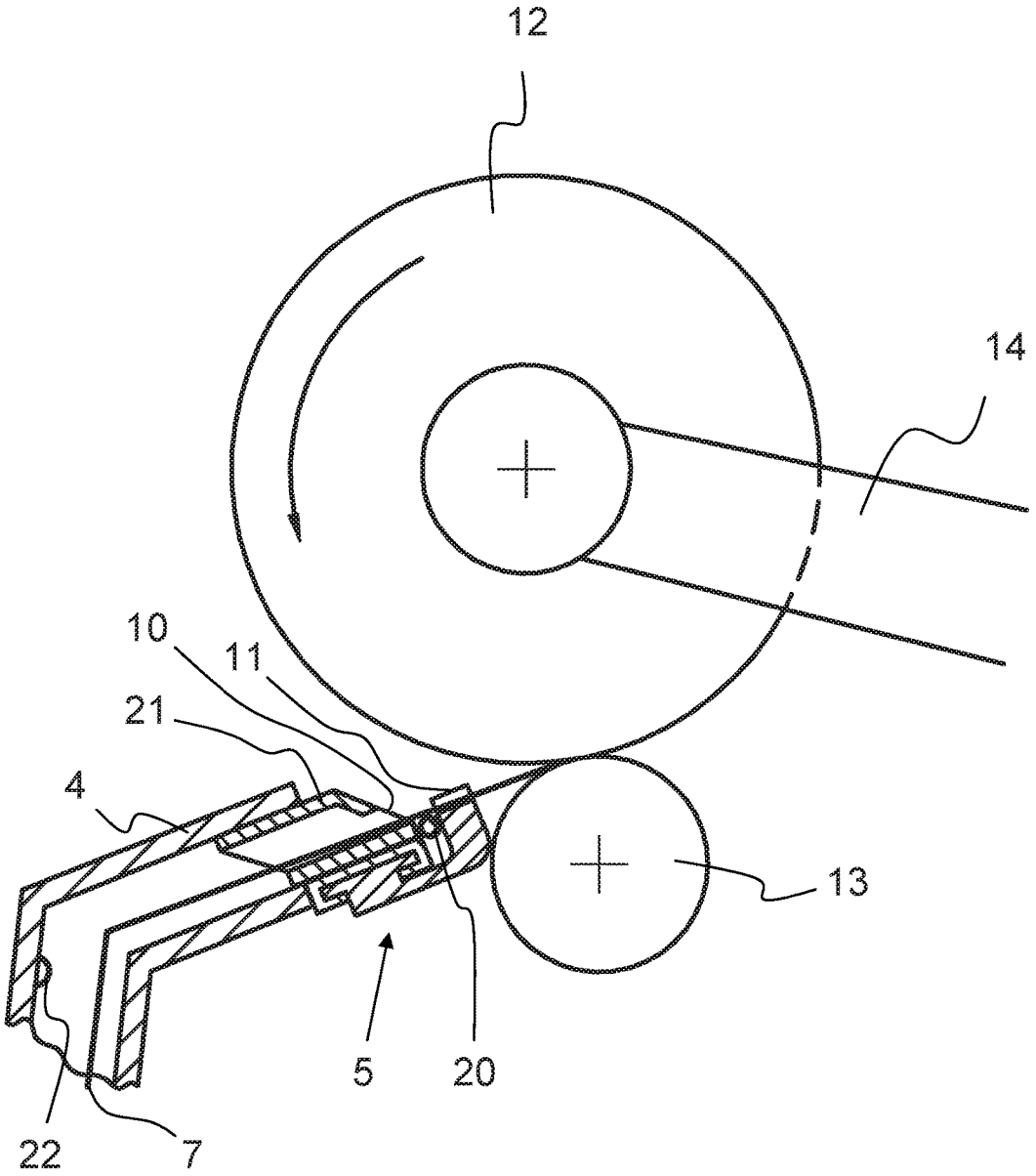
FIG. 5 is a schematic presentation of an extraction mouth upon the delivery of a thread.

FIG. 5 shows in detail the suction nozzle 4 with the extraction mouth 10. The thread guide 11 of the thread traversing device 5 is arranged between the extraction mouth 10 and the bobbin 12 or the winding roller 13, as the case may be, which drives the bobbin 12. The thread guide 11 moves the thread 7 back and forth in front of the bobbin 12, such that a cross-wound bobbin is produced. A thread lifter 20 is arranged below the thread 7, between the extraction mouth 10 and the thread guide 11. In this presentation, which shows the delivery of the thread 7, the thread 7 extends away through the thread lifter 20.

The thread 7 is detected in the suction nozzle 4 by means of a sensor 22. This sensor 22 may be active, for example, during normal thread delivery. However, it is more advantageous if the sensor 22 is used to detect whether the thread has been captured by the suction nozzle 4 upon the return delivery from the bobbin 12.

At the extraction mouth 10, the thread 7 exits the suction nozzle 4. The extraction mouth 10 is arranged in a mouth piece 21, which is located in the suction nozzle 4. It may also be arranged, completely or partially, outside of the suction nozzle 4. The mouth piece 21 is attached in the suction nozzle 4 in a displaceable manner. The displacement essentially takes place in the longitudinal thread direction, such that the mouth piece 21 can be brought more or less close to the bobbin 12.

Figure 6:
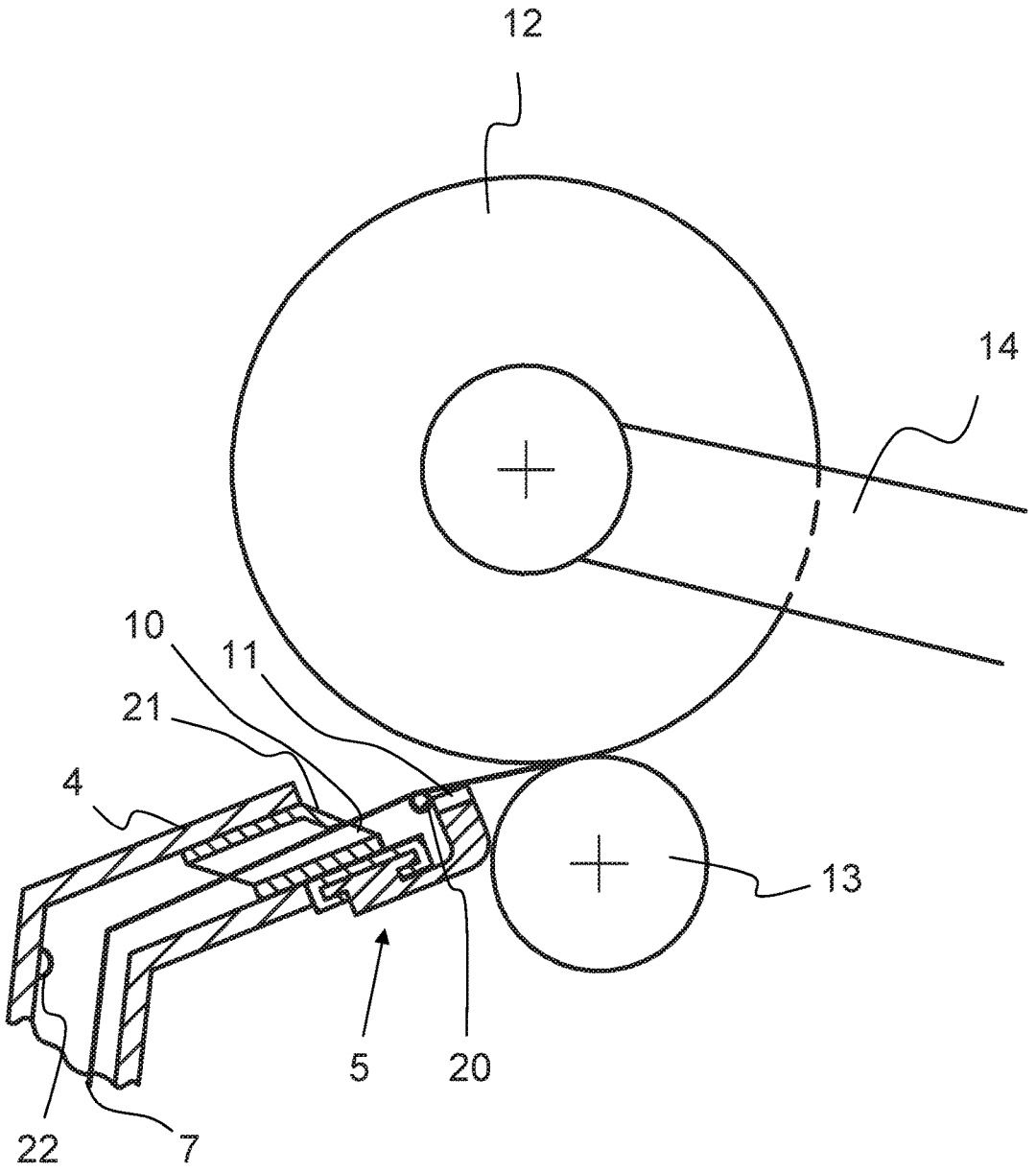
FIG. 6 is the extraction mouth from FIG. 5 with a raised thread.

As is shown in FIG. 6, the thread lifter 20 is coupled with the mouth piece 21. In FIG. 6, compared to FIG. 4, the mouth piece 21 is further away from the bobbin 12. Thus, it is further inserted into the suction nozzle 4. Thus, the mouth piece 21 or the extraction mouth 10, as the case may be, is located in a second position, which is further away from the bobbin 12 than it is in the first position of FIG. 5.

Through the second position of the mouth piece 21 or the extraction mouth 10, as the case may be, the thread lifter 20 has been moved to a raised position. The thread lifter 20 engages in this position under the thread 7 and lifts it out of the thread guide 11. Thus, the thread guide 11 is no longer able to oscillate the thread 7 back and forth. This position is advantageous if the thread 7 is located in the suction nozzle 4, but a winding onto the bobbin 12 is not intended. This may be advantageous, for example, upon a controlled delivery stop of the thread 7. Another situation in which this position of the thread 7 outside of the thread guide 11 is desired, is (for example) upon the piecing of the previously broken thread 7.

Figure 7:
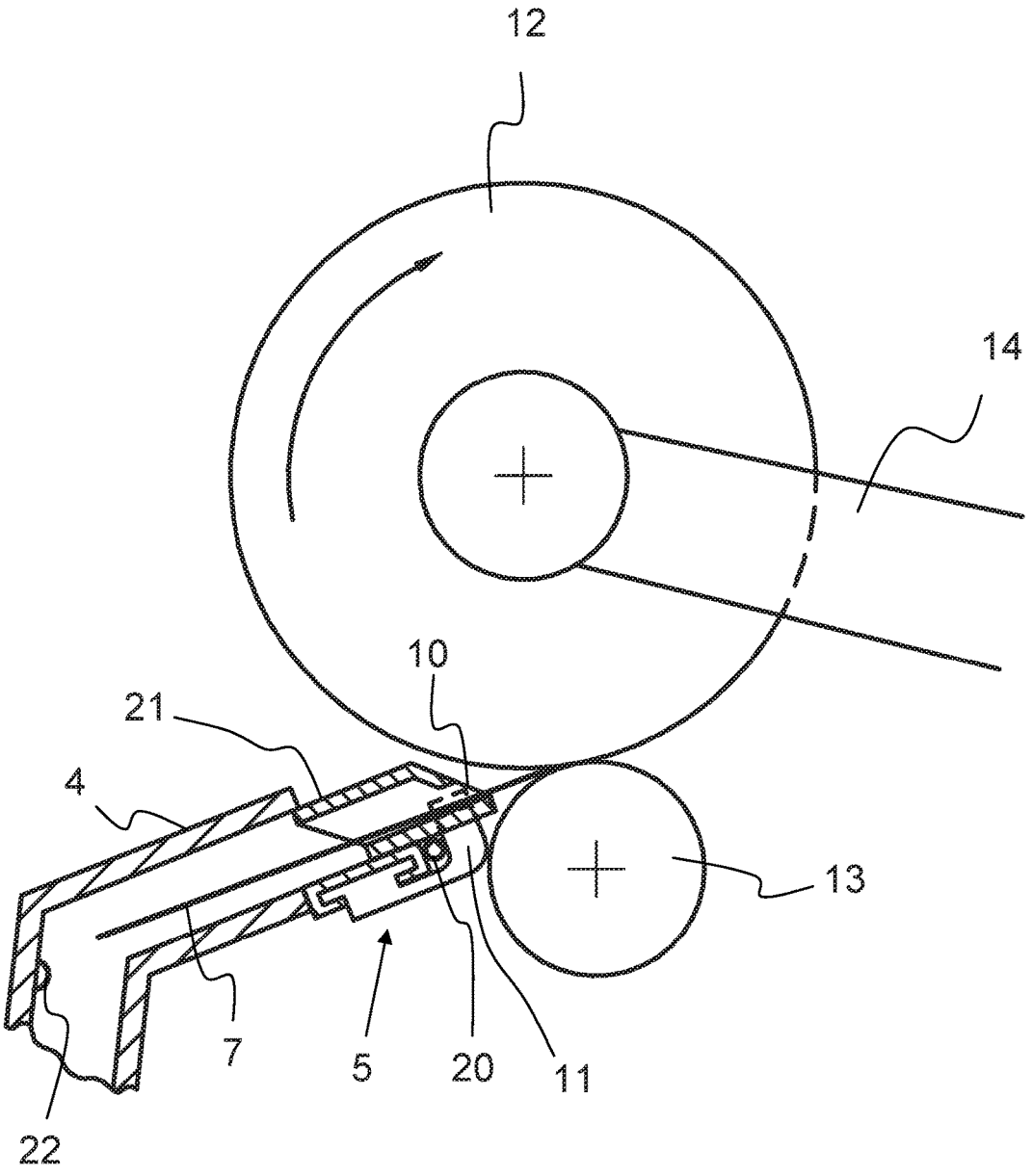
FIG. 7 is the extraction mouth from FIG. 5 in a thread search position.

FIG. 7 shows a third position of the extraction mouth 10. In this position, the extraction mouth 10 is very close to the surface of the bobbin 12. Here, the mouth piece 21 is almost fully extended from the suction nozzle 4. The thread lifter 20 is located in a lower position, such that the mouth piece 21 can be moved away through it. In order to avoid a collision with the thread guide 11, the thread guide 11 has been moved from the area of the mouth piece 21 by means of the thread traversing device 5. The thread guide 11 is correspondingly located on the side of the mouth piece 21. By subjecting the suction nozzle 4 to negative pressure in accordance with the versions under FIGS. 1 to 4, negative pressure is applied to the extraction mouth 10, which sucks in a thread end found on the circumference of the bobbin 12. The bobbin 12 rotates in the direction of the arrow counter to the delivery direction, and thereby conveys the thread end into the suction nozzle 4. The sensor 22 detects whether the thread end is located in the suction nozzle 4, and may accordingly terminate the sucking in or initiate further handling steps.

Figure 8A:
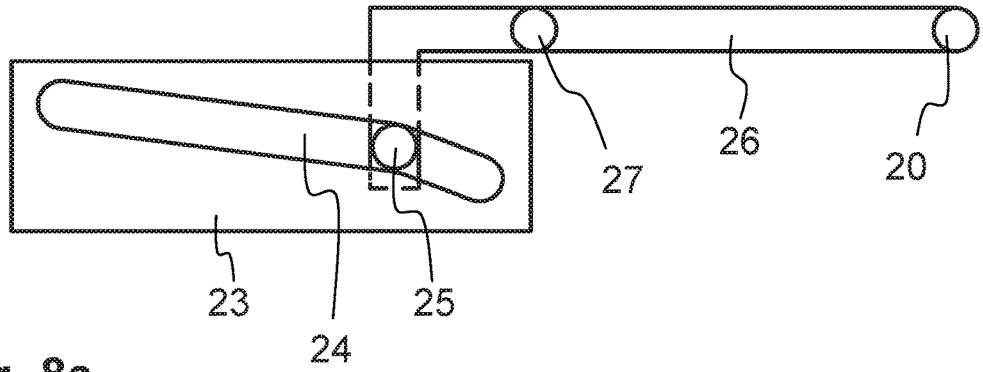
FIG. 8*a* is a slotted link guide of a thread lifter in normal position.
Figure 8B:
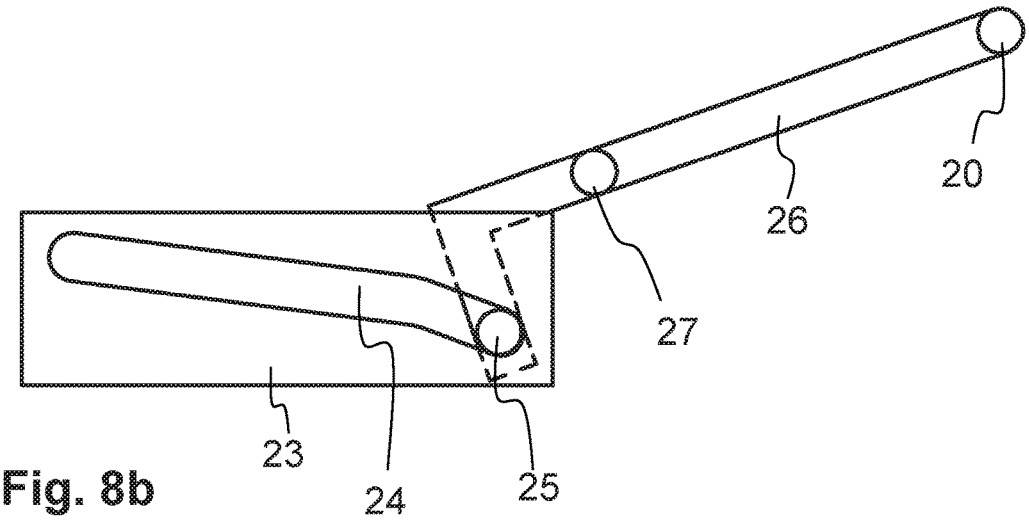
FIG. 8*b* is the slotted link guide from FIG. 8*a* with a retracted slotted link and a raised thread lifter.
Figure 8C:
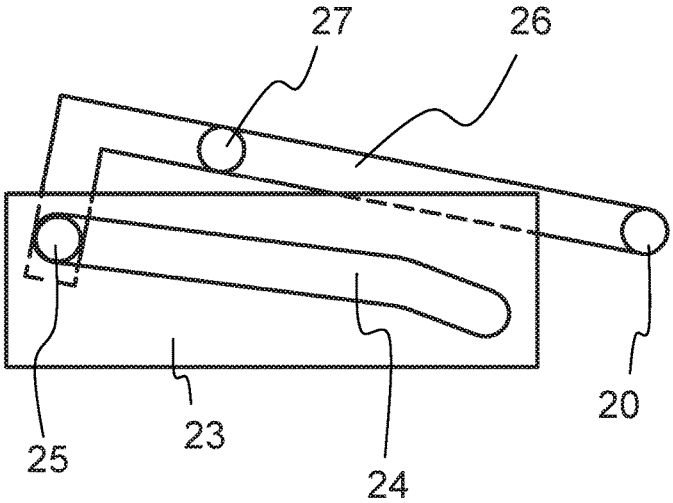
FIG. 8*c* is the slotted link guide from FIG. 8*a* in a front position with a lowered thread lifter.

FIGS. 8*a*, 8*b* and 8*c* show a slotted link 23 for the thread lifter 20 in the three positions described above. The slotted link 23 is connected to the mouth piece 21 and is moved in the longitudinal direction together with the mouth piece 21. It features a slotted link guide 24 in which a slotted link block 25 is guided. The thread lifter 20 is connected through a rod 26 to an axis of rotation 27 and the slotted link block 25. Through the movement of the slotted link 23 in the longitudinal direction, the slotted link block 25 is moved within the slotted link guide 24 and correspondingly raises or lowers the thread lifter 20 to or from.

In the presentation of FIG. 8*a*, the thread lifter 20 is located in a middle position. Accordingly, the slotted link 23 is also located in a middle position, which corresponds to the presentation in FIG. 5 with the corresponding mouth piece 21.

If, together with the slotted link 23, the mouth piece 21 is moved into the remote position in accordance with FIG. 6 or 8*b*, the slotted link guide 24 causes the slotted link block 25 to be guided downward. Thereby, the thread lifter 20 is raised, in order to lift the thread 7 from the thread guide 11 in accordance with FIG. 6.

FIG. 8*c* shows the front position of the slotted link 23 and the mouth piece 21 from FIG. 7. In this position, the slotted link block 25 is located at the other end of the slotted link guide 24. Through the axis of rotation 27, the thread lifter 20 is moved to a lower position, such that it frees the path for the mouth piece 21, and that the mouth piece 21 can be moved in the front position near the bobbin.

This invention is not limited to the illustrated and described embodiments. Variations within the scope of the claims, just as the combination of characteristics, are possible, even if they are illustrated and described in different embodiments.

LIST OF REFERENCE SIGNS

1 Workstation
2 Spinning unit
3 Thread delivery device
4 Suction nozzle
5 Thread traversing device
6 Winding device
7 Thread
8 Delivery rollers
9 Inlet mouth
10 Extraction mouth
11 Thread guide
12 Bobbin
13 Winding roller
14 Bobbin arm
15 Connection mouth
16 Suction line
17 Extraction system
18 Valve
19 Connection element
20 Thread lifter
21 Mouth piece
22 Sensor
23 Slotted link
24 Slotted link guide
25 Slotted link block
26 Rod
27 Axis of rotation
28 Closing element

The invention claimed is:

1. A method for operating a spinning machine having a plurality of spinning units for (a) delivering a thread produced at the spinning units and drawn off by delivery rollers to a bobbin, (b) laying the thread on the bobbin, (c) winding the thread on the bobbin, and (d) finding a thread end wound on the bobbin by means of a suction nozzle, the method comprising:

running the thread through the suction nozzle during the delivery of the thread to the bobbin such that the thread enters a first opening in the suction nozzle serving as an inlet mouth for the thread and exits the suction nozzle through a second opening serving as an extraction mouth for the thread;

after the delivery rollers at the spinning unit, running the thread to the inlet mouth of the suction nozzle directly in front of the bobbin; and wherein for the finding of the thread end wound on the bobbin, the thread end is sucked into the suction nozzle through the extraction mouth.

2. The method according to claim 1, further comprising connecting the suction nozzle to an extraction system through the inlet mouth or a third opening in the nozzle serving as a connection mouth upon the sucking in of the thread end.

3. A method for operating a textile machine having a plurality of workstations for (a) delivering a thread to a bobbin, (b) laying the thread on the bobbin, (c) winding the thread on the bobbin, and (d) finding a thread end wound on the bobbin by means of a suction nozzle, the method comprising:

running the thread through the suction nozzle during the delivery of the thread to the bobbin such that the thread enters a first opening in the suction nozzle serving as an inlet mouth for the thread and exits the suction nozzle through a second opening serving as an extraction mouth for the thread;

starting from a thread delivery device at the workstation, running the thread to the inlet mouth of the suction nozzle directly in front of the bobbin;

wherein for the finding of the thread end wound on the bobbin, the thread end is sucked into the suction nozzle through the extraction mouth; and further comprising connecting the suction nozzle to an extraction system through a third opening in the nozzle serving as a connection mouth and sealing the inlet mouth of the suction nozzle upon the sucking in of the thread end.

4. The method according to claim 1, further comprising connecting the inlet mouth to an extraction system through a connection element upon the sucking in of the thread end.

5. A method for operating a textile machine having a plurality of workstations for (a) delivering a thread to a bobbin, (b) laying the thread on the bobbin, (c) winding the thread on the bobbin, and (d) finding a thread end wound on the bobbin by means of a suction nozzle, the method comprising:

running the thread through the suction nozzle during the delivery of the thread to the bobbin such that the thread enters a first opening in the suction nozzle serving as an inlet mouth for the thread and exits the suction nozzle through a second opening serving as an extraction mouth for the thread;

starting from a thread delivery device at the workstation, running the thread to the inlet mouth of the suction nozzle directly in front of the bobbin;

wherein for the finding of the thread end wound on the bobbin, the thread end is sucked into the suction nozzle through the extraction mouth; and further comprising moving the extraction mouth between different distance positions from the bobbin circumference in performance of different ones of functions (a) through (d).

6. The method according to claim 5, wherein movement of the extraction mouth between the different distance positions is coupled with movement of a thread lifter or a thread guide of a thread traversing device at the work station.

7. The method according to claim 6, wherein the extraction mouth is: (a) at a first position for running the thread through the suction nozzle during the delivery of the thread to the bobbin; (b) at a second position closer to the bobbin than the first position when the thread end is sought on the bobbin by the extraction mouth; and (c) at a third position more distant to the bobbin than the first position when the thread lifter is actuated for lifting the thread from the thread traversing device.

8. The method according to claim 7, wherein the second position of the extraction mouth is adjusted as a function of bobbin diameter or the thread to be received.

9. A spinning machine having a plurality of spinning units for production of a thread, wherein each spinning unit comprises:

a thread delivery device with delivery rollers that draw off the thread from the spinning unit and deliver the thread to a bobbin;

a thread traversing device that lays the thread on the bobbin;

a winding device that winds the thread onto the bobbin; and a suction nozzle that finds a thread end wound on the bobbin, the suction nozzle comprising an opening turned towards the bobbin circumference that serves as an extraction mouth for sucking in the thread end;

the suction nozzle further comprising an additional opening that serves as an inlet mouth for the thread, wherein during delivery of the thread to the bobbin, the thread enters the suction nozzle through the inlet mouth, runs through the suction nozzle, and exits the suction nozzle through the extraction mouth;

wherein the suction nozzle is arranged directly in front of the bobbin such that the thread, starting from the thread delivery device, initially runs free and enters the suction nozzle directly in front of the bobbin.

10. The spinning machine according claim 9, wherein the suction nozzle is arranged at the spinning unit in a stationary manner.

11. The spinning machine according to claim 9, wherein the suction nozzle is connectable to an extraction system through the inlet mouth or through a further opening in the suction nozzle serving as a connection mouth.

12. The spinning machine according to claim 9, wherein the suction nozzle is connectable to an extraction system through a further opening in the suction nozzle serving as a connection mouth, and further a closing element configured with the inlet mouth to seal the suction nozzle upon the sucking in of the thread end.

13. The spinning machine according to claim 9, wherein the suction nozzle is connectable to an extraction system through the inlet mouth, and further comprising a connection element that is movable to the inlet mouth to connect the suction nozzle with the extraction system upon the sucking in of the thread end.

14. The spinning machine according to claim 9, wherein the extraction mouth is adjustable between a plurality of distance positions relative to a circumference of the bobbin.

15. The spinning machine according to claim 14, wherein the extraction mouth is configured with the thread lifter or with a thread guide of the thread traversing device at the spinning unit.

16. The spinning machine according to claim 15, wherein the thread traversing device and the winding device comprise individual drives.

* * * * *